US008291979B2

(12) United States Patent
Oddie

(10) Patent No.: US 8,291,979 B2
(45) Date of Patent: Oct. 23, 2012

(54) CONTROLLING FLOWS IN A WELL

(75) Inventor: Gary M. Oddie, St. Neots (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 230 days.

(21) Appl. No.: 11/691,576

(22) Filed: Mar. 27, 2007

(65) Prior Publication Data

US 2008/0236839 A1 Oct. 2, 2008

(51) Int. Cl.
*E21B 43/12* (2006.01)

(52) U.S. Cl. ..... 166/313; 166/68; 166/372; 166/105

(58) Field of Classification Search ..... 166/313, 166/68, 372, 105
See application file for complete search history.

(56) References Cited

U.S. PATENT DOCUMENTS

| | | | | | |
|---|---|---|---|---|---|
| 2,246,811 | A | | 6/1941 | Otis | |
| 2,658,457 | A | | 11/1953 | Harbison | |
| 2,822,048 | A | * | 2/1958 | Tausch | 166/114 |
| 3,359,740 | A | | 12/1967 | Cochrane | |
| 3,410,217 | A | | 11/1968 | Kelly et al. | |
| 3,559,740 | A | | 2/1971 | Scaggs | |
| RE28,588 | E | * | 10/1975 | Sizer et al. | 166/321 |
| 4,738,313 | A | | 4/1988 | McKee | |
| 4,738,779 | A | | 4/1988 | Carroll et al. | |
| 4,937,946 | A | | 7/1990 | Steinhoff | |
| 5,128,052 | A | * | 7/1992 | Bullock | 210/808 |
| 5,150,619 | A | | 9/1992 | Turner | |
| 5,560,737 | A | * | 10/1996 | Schuring et al. | 405/128.45 |
| 5,693,225 | A | | 12/1997 | Lee | |
| 5,730,871 | A | | 3/1998 | Kennedy | |
| 5,830,368 | A | | 11/1998 | Peachey | |
| 5,937,946 | A | | 8/1999 | Streetman | |
| 5,961,841 | A | | 10/1999 | Bowers | |
| 5,971,004 | A | | 10/1999 | Pringle | |
| 5,996,690 | A | * | 12/1999 | Shaw et al. | 166/250.01 |
| 6,017,456 | A | | 1/2000 | Kennedy | |
| 6,033,567 | A | | 3/2000 | Lee | |
| 6,068,053 | A | | 5/2000 | Shaw | |
| 6,070,661 | A | | 6/2000 | Kennedy | |
| 6,082,452 | A | * | 7/2000 | Shaw et al. | 166/105.5 |
| 6,138,758 | A | | 10/2000 | Shaw et al. | |
| 6,158,714 | A | | 12/2000 | Lembcke | |
| 6,189,613 | B1 | | 2/2001 | Chachula et al. | |
| 6,196,312 | B1 | | 3/2001 | Collins et al. | |

(Continued)

FOREIGN PATENT DOCUMENTS

CA 2428056 C 11/2006

(Continued)

OTHER PUBLICATIONS

GCC Search Exam Report to GCC Application No. GCC/P/2008/11609 dated Sep. 21, 2011.

(Continued)

*Primary Examiner* — Nicole Coy
(74) *Attorney, Agent, or Firm* — Jim Patterson

(57) ABSTRACT

A technique includes providing equipment downhole in a well to receive flows. The technique includes regulating a ratio of the flows in the well. The regulation includes regulating the ratio of the flows such that the ratio is substantially independent of pressures of the flows downstream of a point at which the regulation occurs.

16 Claims, 3 Drawing Sheets

U.S. PATENT DOCUMENTS

| | | | | |
|---|---|---|---|---|
| 6,277,286 | B1 | 8/2001 | Søntvedt et al. | |
| 6,283,204 | B1 | 9/2001 | Brady et al. | |
| 6,336,503 | B1 | 1/2002 | Alhanati et al. | |
| 6,336,504 | B1 | 1/2002 | Alhanati et al. | |
| 6,357,525 | B1 | 3/2002 | Langseth | |
| 6,367,547 | B1 | 4/2002 | Towers et al. | |
| 6,394,183 | B1 | 5/2002 | Schrenkel et al. | |
| 6,397,547 | B1 | 6/2002 | Martensson | |
| 6,547,005 | B2 | 4/2003 | Haheim | |
| 6,659,184 | B1 | 12/2003 | Tips | |
| 6,719,048 | B1 | 4/2004 | Ramos et al. | |
| 6,732,801 | B2 * | 5/2004 | Ohmer et al. | 166/313 |
| 6,755,978 | B2 | 6/2004 | Oddie | |
| 6,761,215 | B2 | 7/2004 | Morrison et al. | |
| 6,786,285 | B2 | 9/2004 | Johnson | |
| 6,881,329 | B2 | 4/2005 | Amado | |
| 6,883,613 | B2 | 4/2005 | Bode | |
| 6,989,103 | B2 | 1/2006 | Mohsen | |
| 6,993,432 | B2 | 1/2006 | Jenkins et al. | |
| 7,055,598 | B2 | 6/2006 | Ross | |
| 7,059,401 | B2 | 6/2006 | Bode | |
| 7,164,990 | B2 | 1/2007 | Bratvedt | |
| 7,314,559 | B2 | 1/2008 | Hopper | |
| 7,814,976 | B2 | 10/2010 | Hackworth et al. | |
| 7,828,058 | B2 | 11/2010 | Fielder | |
| 8,006,757 | B2 | 8/2011 | Hackworth et al. | |
| 2001/0007283 | A1 | 7/2001 | Johal et al. | |
| 2001/0017207 | A1 | 8/2001 | Haheim | |
| 2002/0023750 | A1 | 2/2002 | Lopes et al. | |
| 2002/0059866 | A1 | 5/2002 | Grant | |
| 2002/0134554 | A1 | 9/2002 | Schrenkel et al. | |
| 2002/0195250 | A1 * | 12/2002 | Underdown et al. | 166/357 |
| 2002/1955250 | | 12/2002 | Underdown et al. | |
| 2004/0045708 | A1 | 3/2004 | Morrison et al. | |
| 2005/0034875 | A1 | 2/2005 | McLoughlin | |
| 2005/0087336 | A1 | 4/2005 | Surjaatmadja et al. | |
| 2005/0236324 | A1 | 10/2005 | Mildren et al. | |
| 2006/0037746 | A1 | 2/2006 | Wright et al. | |
| 2006/0175052 | A1 | 8/2006 | Tips | |
| 2007/0078703 | A1 | 4/2007 | Shipley | |
| 2008/0236821 | A1 | 10/2008 | Fielder | |
| 2009/0056939 | A1 | 3/2009 | Hackworth et al. | |
| 2009/0065431 | A1 | 3/2009 | Bakke et al. | |
| 2009/0242197 | A1 | 10/2009 | Hackworth et al. | |
| 2010/0096142 | A1 | 4/2010 | Randazzo | |
| 2011/0000675 | A1 | 1/2011 | Hackworth et al. | |

FOREIGN PATENT DOCUMENTS

| | | | |
|---|---|---|---|
| CA | 2638532 | A1 | 2/2009 |
| EA | 006477 | B1 | 12/2005 |
| EP | 1279795 | B1 | 5/2008 |
| GB | 2369631 | | 6/2002 |
| GB | 2452372 | B | 7/2010 |
| GB | 2462738 | B | 7/2010 |
| RU | 57813 | | 10/2006 |
| RU | 2290505 | C1 | 12/2006 |
| RU | 2291291 | C1 | 1/2007 |
| WO | 9708459 | | 3/1997 |
| WO | 0131167 | | 5/2001 |
| WO | 0131167 | | 5/2001 |
| WO | 0165064 | A1 | 9/2001 |
| WO | 0131167 | | 10/2001 |
| WO | 2006032141 | A1 | 3/2006 |
| WO | 2006032141 | | 6/2006 |
| WO | 2006067151 | | 6/2006 |

OTHER PUBLICATIONS

Decision of Grant of the Russian Federation Patent Application No. 2008111645 dated Feb. 16, 2012.

* cited by examiner

CONTROLLING FLOWS IN A WELL

BACKGROUND

The invention generally relates to controlling flows in a well.

In the downhole environment, there are many applications which involve controlling flows. For example, a typical downhole completion may include an oil/water separator, which receives a produced well fluid mixture and separates the mixture into corresponding water and oil flows. The water flow may be reintroduced into the well, and for this purpose, the downhole system may be designed for purposes of generally establishing the rate at which water is introduced back into the well.

The conventional way of controlling a flow in the downhole environment involves the use of a lossy device, such as an orifice or other restriction. The size of the flow path through the device may be determined, for example, using simple hydraulic calculations, which are based on the assumption that the downhole hydraulic parameters are relatively constant over time. However, when the pressure and/or flow characteristic of one part of the hydraulic system changes, the whole flow balance may be disturbed, as the calculated size is no longer correct.

Thus, there is a continuing need for better ways to control flows in a well.

SUMMARY

In an embodiment of the invention, a technique that is usable with a well includes providing downhole equipment and regulating a ratio of flows that are provided to the equipment.

In another embodiment of the invention, a system that is usable with a well includes communication paths, which are located in the well to receive flows. A controller of the system regulates a ratio of the flows.

Advantages and other features of the invention will become apparent from the following drawing, description and claims.

DETAILED DESCRIPTION

Figure 1:
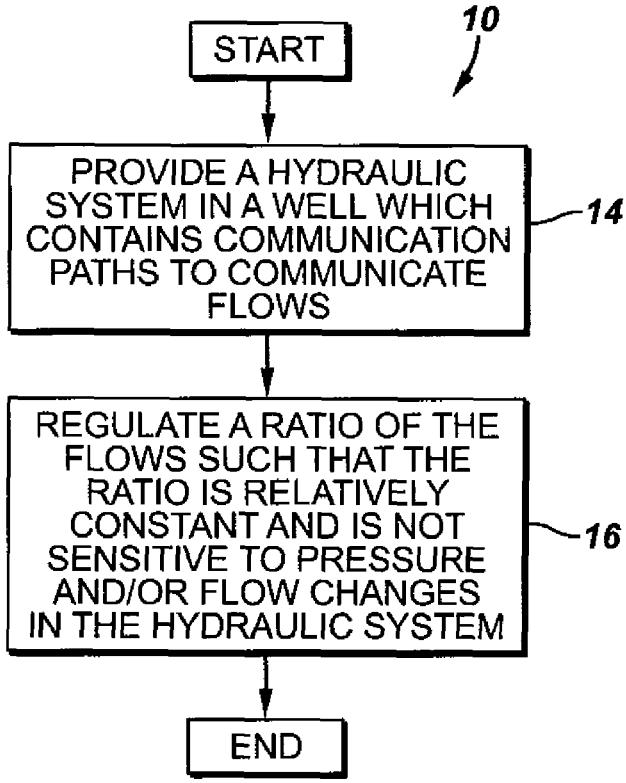
FIG. 1 is a flow diagram depicting a technique to control flows in a well according to an embodiment of the invention.

In accordance with embodiments of the invention described herein, flows in the downhole environment are controlled by regulating a ratio of the flows. Thus, this approach overcomes challenges of conventional downhole hydraulic systems in which orifice sizes and other hydraulic parameters were designed based on the assumption that no changes would occur to downhole flow rates, pressures, etc. More specifically, referring to FIG. 1, a technique 10 in accordance with some embodiments of the invention includes providing (block 14) a hydraulic system in a well, which contains communication paths to communicate flows. A ratio of the flows is regulated (block 16) such that the ratio is relatively constant and is not sensitive to pressure and/or flow changes in the hydraulic system.

Figure 2:
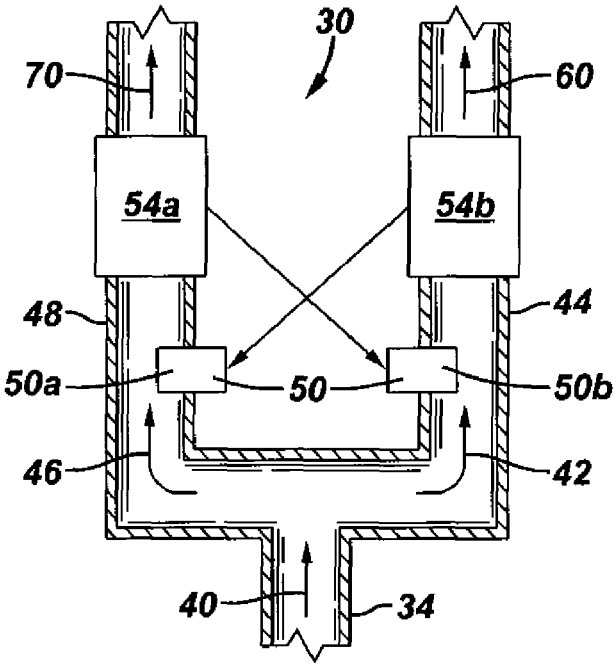
FIG. 2 is a schematic diagram of a system to regulate flows in a well produced by a single input flow according to an embodiment of the invention.

As a more specific example, FIG. 2 depicts a system 30 to regulate flows in a well according to some embodiments of the invention. The system 30 includes two cross-coupled hydraulic flow control subsystems, which regulate outlet flows 60 and 70 that are produced in response to an inlet flow 40. More specifically, the inlet flow 40 (communicated through a conduit 34) is split into two intermediate flows 42 and 46, which are communicated through conduits 44 and 48, respectively, to flow controllers 50 (a flow controller 50*a* for the intermediate flow 46 and a flow controller 50*b* for the intermediate flow 42). The control of the intermediate flow 42 by the flow controller 50*b* produces the outlet flow 60; and the control of the intermediate flow 46 by the flow controller 50*a* produces the outlet flow 70.

Flow sensors 54*a* and 54*b* are coupled to sense the flows 46 and 42, respectively, and provide positive feedback to the flow controller 50 in the other flow path. In this manner, the flow controller 50*a* controls the outlet flow 70 based on the outlet flow 60, which is sensed by the flow sensor 54*b*. Similarly, the flow controller 50*b* regulates the outlet flow 60 based on the outlet flow 70 that is sensed by the flow sensor 54*a*. Due to the positive feedback provided by this control scheme, the flow controller 50*a* increases the outlet flow 70 in response to sensing an increase in the outlet flow 60. Likewise, the flow controller 50*b* increases the outlet flow 60 in response to the sensing of an increase in the outlet flow 70.

Figure 3:
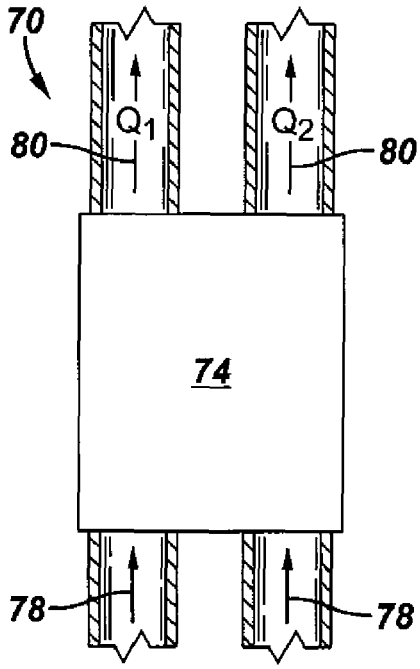
FIG. 3 is a schematic diagram of a system to regulate flows in a well produced by multiple input flows according to an embodiment of the invention.

Although FIG. 2 depicts a control scheme for use with a single inlet flow, a similar control scheme may be used to control the ratios of flows that are produced by parallel inlet flows, in accordance with other embodiments of the invention. More specifically, FIG. 3 depicts an embodiment of such a system 76 in accordance with some embodiments of the invention. As depicted in FIG. 3, the system 76 receives parallel inlet flows 78. The system 76 may contain, for example, a passive device 74 that regulates resultant outlet flows 80, which are produced in response to the parallel inlet flows 78, such that a ratio of the outlet flows 80 is relatively constant. Thus, for two outlet flows Q1 and Q2, the system 76 generally maintains the following relationship:

$$Q_1/Q_2=k, \qquad \text{Eq. 1}$$

where "k" represents a constant.

Figure 4:
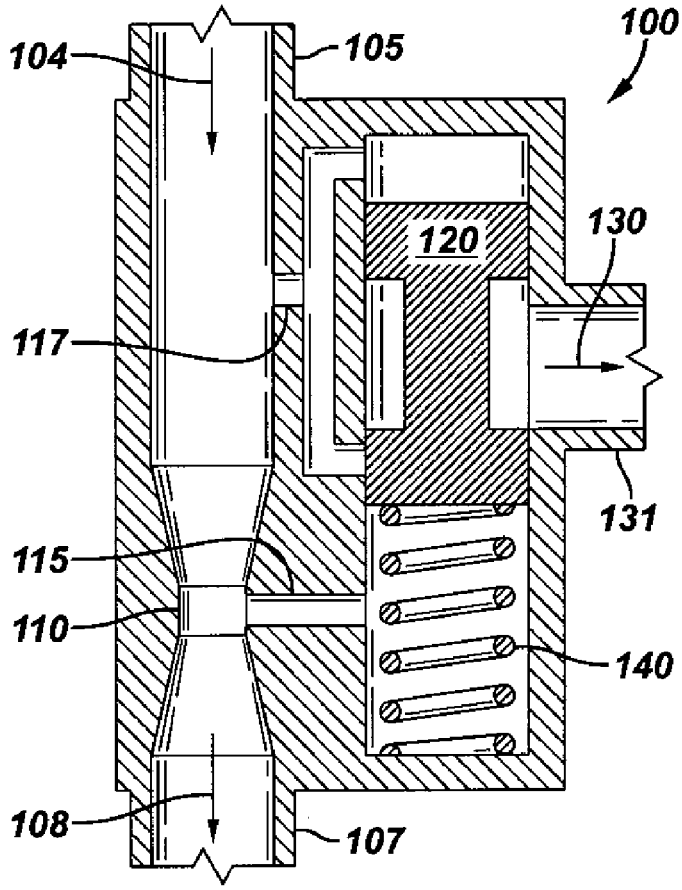
FIG. 4 is a schematic diagram illustrating a venturi-based flow split controller according to an embodiment of the invention.

As a more specific example, the passive device 74 (see FIG. 3) may be a venturi or orifice plate mechanism, in accordance with some embodiments of the invention. As an example, FIG. 4 depicts a passive, venturi-based flow split controller 100 in accordance with some embodiments of the invention. Referring to FIG. 4, the flow split controller 100 receives a single inlet flow 104 (for this example) at an inlet 105. The inlet flow 104 flows through a main flow path of a venturi 110 to produce a corresponding outlet flow 108 at an outlet 107. The venturi 110 includes a suction inlet 115, which exerts a suction force against a piston 120 in response to the flow through the main flow path of the venturi 110. The suction caused by the flow through the main flow path of the venturi 110 causes the piston 120 to counter an opposing force, which is exerted by a spring 140 and move to open flow through a flow path 117. The flow path 117, in turn, is in communication with the inlet 105. Thus, for a given flow through the venturi 110, fluid communication is opened through the path 117 to create a corresponding outlet flow at another outlet 131 of the flow divider 100. When the outlet flow 108 increases, this causes a corresponding increase in the suction at the suction line 115 to further open the path 117 to further increase the outlet flow 130. Thus, the flow split controller 100 provides positive feedback for purposes of regulating the ratio of the outlet flows 108 and 130 to be relatively constant.

It is noted that the flow split controller 100 is depicted in FIG. 4 and described herein merely for purposes of describing a passive flow divider, or flow split controller, that may be used in the downhole environment in accordance with some embodiments of the invention. Other passive or non-passive flow split controllers may be used in accordance with other embodiments of the invention.

Figure 5:
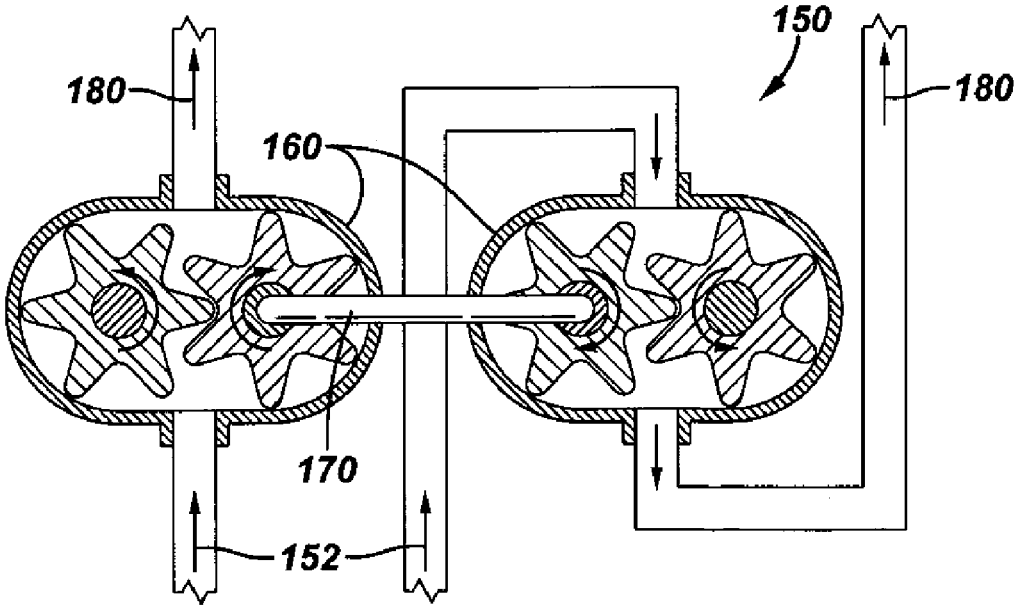
FIG. 5 is a schematic diagram illustrating a mechanical feedback-based flow split controller according to an embodiment of the invention.

Referring to FIG. 5, as another example, in accordance with some embodiments of the invention, a system 150 uses two positive displacement devices 160 for purposes of regulating the ratios of two outlet flows 180. In general, the positive displacement devices 160 each includes fins, or turbines, which turn in response to a received inlet flow 152. Due to a mechanical coupling 170 between the positive displacement devices 160, the rotation of the displacement devices is controlled in part through the positive feedback from the other device 160. Thus, an increased flow through one of the positive displacement devices 160 causes a corresponding increase in flow in the other positive displacement device 160.

The flow control systems, which are disclosed herein may have many downhole applications. As a specific example, in accordance with some embodiments of the invention, the flow control systems may be used for purposes of downhole oil and water separation. The basic principle is to take produced fluid (an oil/water mixture, typically with eighty plus percent of water) and pump the produced fluid through a device that separates a proportion of the water from the mixture and reinjects the water into a downhole disposal zone. As a more specific example, FIG. 6 depicts a well 200, which includes a flow split controller 244 in accordance with some embodiments of the invention.

Figure 6:
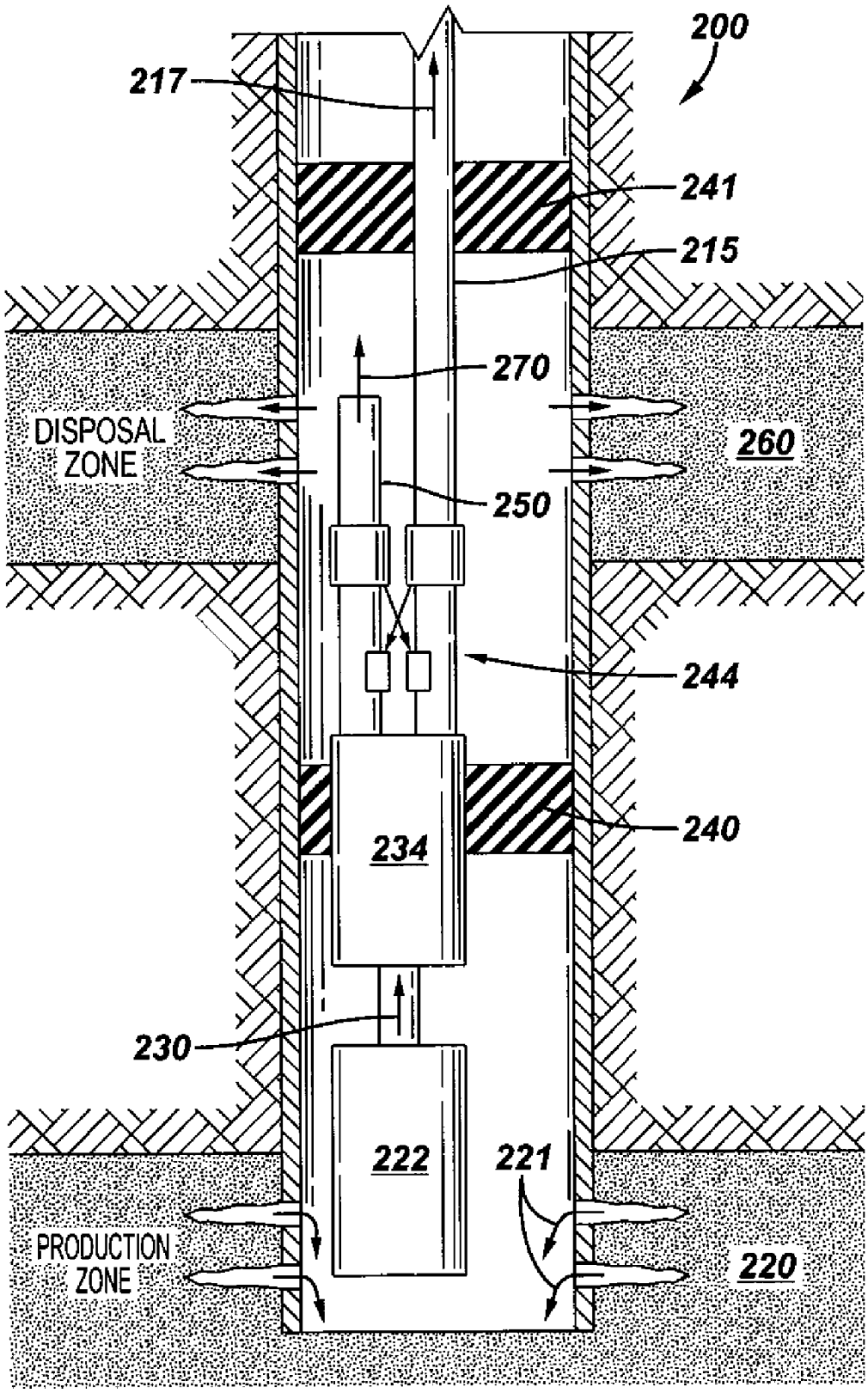
FIG. 6 is a schematic diagram of a well according to an embodiment of the invention.

As depicted in FIG. 6, the well 200 includes a producing zone 220, which is located below a lower packer 240 and a water disposal zone 260, which is located between the lower packer 240 and an upper packer 241. A pump 222 of the well 200 receives a produced well fluid mixture 221, which contains oil and water. The pump 222 produces an output flow 230, which passes into an oil/water separator 234, which may be a hydrocyclone, in accordance with some embodiments of the invention. The hydrocyclone 234 produces two flows a water flow and an oil flow.

Without proper regulation of the ratio of the oil and water flows, several problems may be encountered. For example, if the amount of water production increases more than expected, the rate at which the water is reinjected into the disposal zone 260 must be increased, in order to avoid producing the water to the surface of the well 200. If the water production is significantly less than expected, oil may be injected into this disposal zone 260. Therefore, by controlling the ratio of the oil and water flows, the efficiency of the water removal and oil production processes is maximized.

As depicted in FIG. 6, the flow split controller 244 produces a water flow 270, which is communicated through a conduit 250 into the disposal zone 260; and the flow split controller 244 also produces an oil flow 217 to the surface via a conduit, or production string 215.

To summarize, the overall goal of the flow split controller is to maintain a flow split ratio at some constant ratio in the downhole environment. The flow split controller senses the changes in flow or pressure and responds to maintain the flow split ratio. This arrangement is to be contrasted to designing a hydraulic system based on an assumed (but possibly inaccurate) model of the flow split; using lossy orifices to force some sort of flow split; or placing a device in the system that maximizes water removal. The latter approach may be significantly more complicated than the use of the flow split controller, as this approach may require sensors for the water and feedback to a flow rate controlling valve.

Several practical issues arise when using flow split controllers in the downhole environment, both general and application specific. The devices are passive (i.e., no external energy required). Therefore, in order to affect the flow split, work must be done and this arises from the losses in the flow measurement device (can be small if a venturi is used) and more so in the flow controller which has to throttle the flow (dominant as typically a partially closed valve). The more control the device has to achieve the greater the losses will be. Thus, significant flow splits against adverse pressure gradients will create the highest pressure drops through the device.

The flow split controllers may have moving parts in order to restrict the flow, and therefore, the presence of solids in the downhole environment may present challenges and possibly preclude positive displacement-type flow controllers. Solids may also be an issue for hydraulic type flow controllers as the flow velocity through the flow sensor and flow controller is high. Usually a flow velocity of several meters per second (m/s) is used in order to achieve sufficient hydraulic forces in the hydraulic feedback. The upper boundary on the flow velocity may be limited by such factors as erosion and the potential for a high flow jamming moving parts.

The devices may have a finite dynamic range depending on the CD versus flow rate characteristic of the flow controllers, but a single device may be able to cover flow split ranging by 10:1 and changes in downstream pressure of one of the flows.

Other challenges may arise in the use of a flow split controller downstream of an oil/water separator, be it a gravity type, hydrocyclone or rotating cyclone. First, the pressures on the two separated flows may not necessarily the same, and secondly, the densities of the two flows may be different. The different inlet pressures may be compensated for in the design of the flow controller in one or both of the lines, either as an offset in the flow controller if the differences are small or as a lossy device (e.g., fixed orifice) in the pressure line.

Using a hydraulic controller involves a flow sensor that has a performance proportional to the square root of density. Thus, differences and changes in the density of one or both of the lines affect the control, but provided there is some knowledge of the initial fluid properties, the initial set point may be made to allow for initial conditions and the square root reduces the sensitivity to this effect. In this configuration the flow sensor for the oil rich line acts on the flow controller for the water rich line and vice versa, so there is a compounded effect of the density contrast between the two lines.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

providing equipment downhole in a well to receive first fluid communicated through a first flow path and second fluid communicated through a second flow path; and regulating total volumetric flow through the second flow path in response to total volumetric flow through the first flow path to maintain a ratio of the volumetric flows relatively constant wherein the volumetric flows are provided via a downhole fluid separator.

2. The method of claim 1, wherein the act of regulating comprises:

providing a flow divider in the well.

3. The method of claim 1, further comprising:

processing fluid communicated through a single input flow to the downhole separator to derive the first and second fluids.

4. The method of claim 1, wherein the act of regulating the ratio of the flows comprises:

regulating the ratio based on multiple input flows.

5. The method of claim 1, wherein the separator comprises:

a hydrocyclone.

6. The method of claim 1, wherein the act of providing comprises:

providing a conduit to communicate at least one of the volumetric flows to the surface of the well.

7. The method of claim 1, wherein the act of providing comprises:

providing at least one conduit to inject at least one of the volumetric flows into the well to avoid producing one of the volumetric flows to the surface of the well.

8. A system usable with a well, comprising:

a first flow path to communicate a first fluid and a second flow path to communicate a second fluid; and a controller to regulate total volumetric flow through the second flow path in response to total volumetric flow through the first flow path to maintain a ratio of the total volumetric flows relatively constant wherein the controller comprises a downhole venturi associated with the first flow path to generate a regulating suction force or a mechanical coupling that mechanically couples a downhole device associated with the first flow path and a downhole device associated with the second flow path.

9. The system of claim 8, wherein the controller comprises a flow divider.

10. The system of claim 8, comprising a conduit that communicates at least one of the volumetric flows to a surface of the well.

11. The system of claim 8, further comprising:

downhole equipment to provide at least one of the fluids to the controller.

12. The system of claim 11, wherein the downhole equipment is adapted to provide the fluids to the controller.

13. The system of claim 8, further comprising:

a first communication path to communicate well fluid produced from the well to the surface of the well; and a second communication path to communicate water produced from the well back into the well.

14. A system usable with a well, comprising:

a first flow path to communicate a first fluid and a second flow path to communicate a second fluid;

a controller to regulate total volumetric flow through the second flow path in response to total volumetric flow through the first flow path to maintain a ratio of the total volumetric flows relatively constant; and a first communication path to communicate one of the volumetric flows from its respective flow path to the surface of the well and a second communication path to communicate the other volumetric flow from its respective flow path into the well.

15. The system of claim 14 wherein the volumetric flows are provided via a downhole fluid separator.

16. The system of claim 15 wherein the downhole fluid separator comprises a hydrocyclone.

* * * * *